United States Patent [19]

Galich

[11] 3,975,017

[45] Aug. 17, 1976

[54] TENNIS RACKET

[75] Inventor: Thomas Patrick Galich, Dana Point, Calif.

[73] Assignee: Professional Amateur Industries, Inc., Costa Mesa, Calif.

[22] Filed: May 10, 1974

[21] Appl. No.: 468,924

[52] U.S. Cl. ..... 273/73 H; 273/73 C

[51] Int. Cl.[2] ..... A63B 49/12

[58] Field of Search ..... 273/73 H, 73 J, 73 E, 273/73 C

[56] References Cited

UNITED STATES PATENTS

| | | | |
|---|---|---|---|
| 1,587,918 | 6/1926 | Morrison | 273/73 J |
| 2,282,195 | 5/1942 | Compte | 273/73 C |
| 2,395,864 | 3/1946 | Geerlings et al. | 273/73 J |
| 3,187,376 | 6/1965 | Laws | 17/52 |
| 3,547,440 | 12/1970 | Deer | 273/73 J |
| 3,582,073 | 1/1971 | Melnick et al. | 273/73 H |
| 3,664,668 | 5/1972 | Held | 273/73 H X |
| 3,702,189 | 11/1972 | Galich | 273/73 H X |
| 3,734,499 | 5/1973 | Goldstein | 273/73 E |
| 3,765,055 | 10/1973 | Lewis | 17/52 |
| 3,815,660 | 6/1974 | Gallagher et al. | 273/73 H X |

FOREIGN PATENTS OR APPLICATIONS

| | | | |
|---|---|---|---|
| 755,257 | 8/1956 | United Kingdom | 273/73 C |
| 21,122 | 10/1901 | United Kingdom | 273/73 E |

*Primary Examiner*—Paul E. Shapiro
*Attorney, Agent, or Firm*—Henry M. Bissell

[57] ABSTRACT

A tennis racket which exhibits, through a novel combination of critical material characteristics (composition, treatment, weight distribution and, particularly, the dimensions of width and thickness of various interrelated frame elements) optimum strength, playability, weight, stability and freedom from deleterious vibration during use. The racket frame is a one-piece forged metal (preferably aluminum) unit having a thickness throughout the head and shaft in the range of 0.580–0.600 inches. The width dimension of the head portion remote from the handle is critically determined at 0.280 ± 0.020 inches. The width of the side portions of the head is critically determined at 0.230 ± 0.020 inches. The width dimension for the portion of the head adjacent the handle is critically determined at 0.200 ± 0.020 inches. Between the respective adjacent portions of the head, the width dimension tapers gradually between the dimensions specified.

13 Claims, 3 Drawing Figures

TENNIS RACKET

BACKGROUND OF THE INVENTION

1. Field of the Invention

This invention relates to rackets for playing sports such as tennis and more specifically to tennis rackets having metal frames.

2. Description of the Prior Art

While metal rackets have been the subject of many patents issued in the United States and elsewhere, for example, U.S. Pat. Nos. 1,524,826 (Icke et al), 1,548,134 (Gallaudet) and British Pat. No. 185,275 accepted Sept. 7, 1922, the acceptance of metal rackets by tennis enthusiasts and particularly professional tennis players has been very slow and only relatively recently have some of the professionals switched from wooden-framed to metal-framed rackets. The reasons are manifold but one of the most prominent reasons has been structural failure of the frame, usually in the region of high-level stressing during use of the racket.

Tubular steel frames were introduced with moderate success but they involved welded joints, such joints being subject to defects and possible breakage and making the racket undesirable for "pro" shop sales.

In my U.S. Pat. No. 3,702,189 I disclosed and described in detail one-piece metal tennis racket frames formed by casting and I suggested the advantages of forging a racket frame from aluminum for added strength. Since the time of my filing the application that resulted in that patent I have engaged in extensive developmental work to optimize the design of a forged aluminum frame.

The inter-related factors which had to be considered were: Weight, Wind Resistance, Strength, Torsional Stability, Balance, Appearance, Reproducibility in Production, Cost of Production, Life and Playability. The meanings of all those factors, except "playability" are quite apparent. The term "playability" is much less precise in its meaning because it includes many of the recited parameters, but it also includes at least one additional parameter which I had not considered in my first design and manufacture of forged aluminum frames. That factor became apparent soon after my first forged-frame rackets (and the first forged-frame rackets to be produced in volume by anyone to my knowledge) got into the hands of semi-professional and professional players. I began to get complaints of "chattering" or undesired vibrations in the handle when a ball struck the strings near the portion of the metal head most remote from the handle.

The cause of this undesirable phenomenon was not apparent but, after struggling with the problem for a period of time, I discovered that the cause of the "chattering" was that when a ball hit the strings near the portion of the rim or head furthest from the handle, instead of strings yielding the frame was yielding. Directional control of the ball was thus lost, and for a professional player that is a serious defect. Greater rigidity of the frame in that region was required. For a given alloy of aluminum the greater strength can only be achieved by a dimensional change, i.e., an increase in the crosssectional area in the affected region of the frame. However, such dimensional changes in one region cannot be made without making compensating changes elsewhere, for balance and strength must also be maintained in a tennis racket for playability and stability.

SUMMARY OF THE INVENTION

It is one of the objects of the present invention to eliminate the problems which have been recited hereinbefore.

It is a further object of this invention to provide a tennis racket frame which is strong, light and has optimum "playability" characteristics.

It is an additional object of this invention to provide a tennis racket frame which is free from unwanted vibrations during its use.

Stated succinctly, this invention involves the determination and embodiment of certain critical dimensions and dimensional relationships for a forged aluminum tennis racket frame whereby weight, balance, life, torsional stability and "playability" are optimized. The result has been what I believe, after due study, to be the first forged aluminum tennis racket frame successfully put into large scale commercial production and with widespread professional and semi-professional acceptance.

BRIEF DESCRIPTION OF THE DRAWINGS

A better understanding of the present invention may be had from the consideration of the following detailed description, taken in conjunction with the accompanying drawings, in which.

DESCRIPTION OF THE PREFERRED EMBODIMENT

Figure 1:
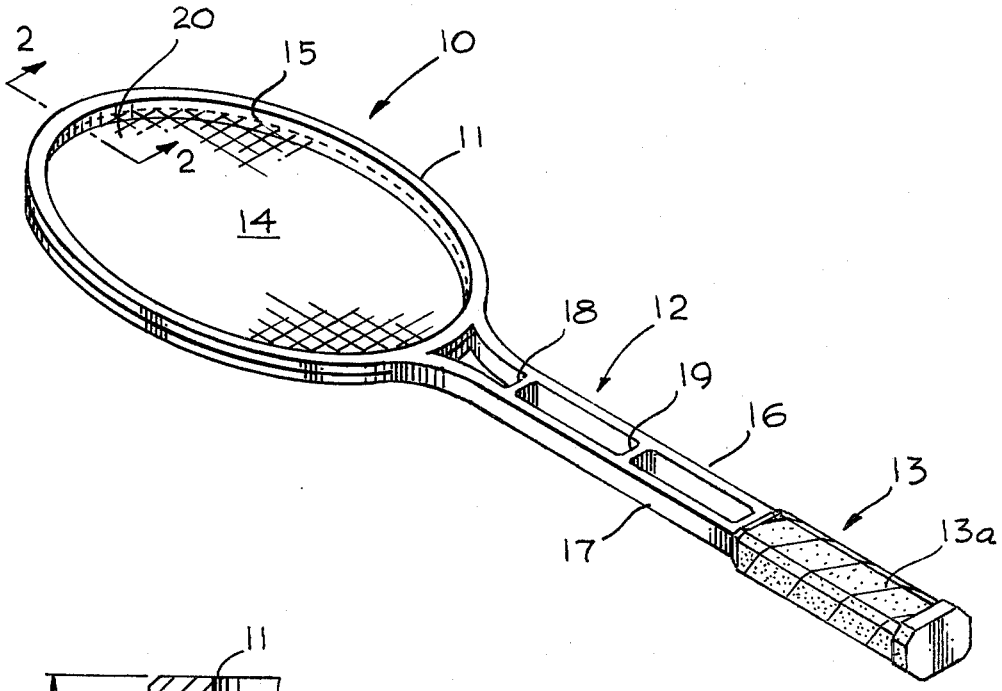
FIG. 1 is a perspective view of one embodiment of this invention.
Figure 3:
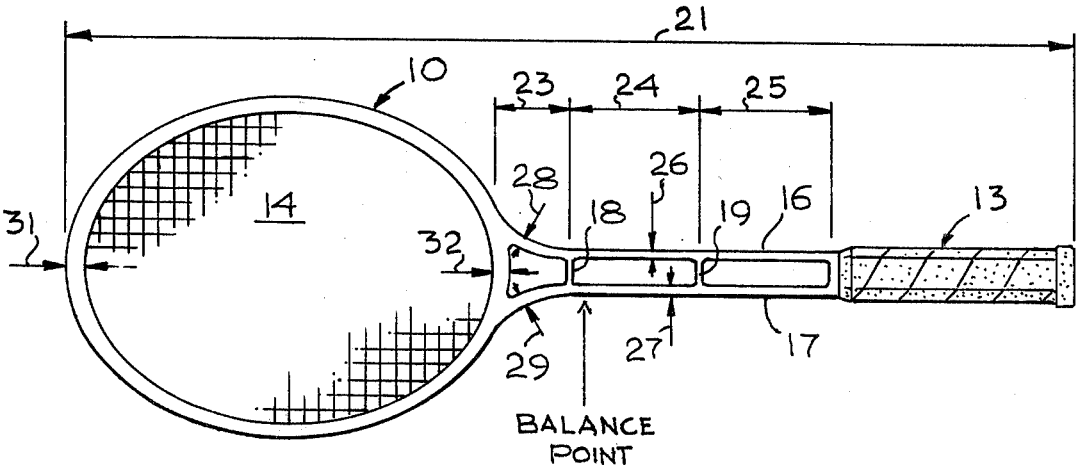
FIG. 3 is a view, in elevation, of the racket frame according to this invention.

In FIG. 1, frame 10, which shall be referred to throughout the specification as a tennis racket frame but may be a frame for a racket used in other spots, such as squash, includes head portion 11, shaft portion 12 and handle portion 13 covered by handgrip 13*a*. Head portion 11, shaft portion 12 and handle 13 are formed integrally in forging and milling operations. Frame 10 may be made of an aluminum alloy designated as 2014-T6although the fabrication of the frame is not limited to the use of that material. For example, 6061-T6 aluminum or any of the "7000" series may also be used. As shown in both FIG. 1 and FIG. 3, the head portion 11 has a standard oval shape and includes netting 14 which may be of gut or any other suitable material including synthetic material such as nylon. Apertures 15 which are radially disposed with respect to the center of the head 11 are provided for the passage of the strings making up netting 14. Apertures 15, in addition to having a direction which is along a radius from the center of head 11, lie in a common plane which is the plane of the netting. In a forged frame according to this invention these holes or apertures are drilled.

Shaft portion 12 comprises a pair of substantially parallel arms or shaft members 16 and 17 which are spaced from each other to permit the passage of air therebetween during the use of the racket. Increased structural strength and rigidity are afforded by a pair of strut elements 18 and 19 disposed approximately as shown in FIG. 1. More detailed dimensions of these struts and their relative positions are set forth in connection with a description of FIG. 3. Struts or bridging elements 18 and 19 are forged integrally with the remainder of frame 10 and maintain the two arm portions 16 and 17 in rigidly affixed juxtaposition. With the rigidity afforded by arms 16 and 17 and strut members 18 and 19, the frame 10 may be fabricated with a substantially thinner frontal area, thus reducing wind resistance. The provision of the struts 18 and 19 and in particular the addition of strut 19 approximately midway between handgrip portion 13*a* and strut 18 serves to significantly reduce the harmonic vibrations which tend to occur in structures of this nature during use. Thus, by reason of strut elements 18 and 19, the problem of acoustic fatigue in frame 10 as a cause of failure for that frame is effectively eliminated. In addition to adding strength to the frame, struts 18 and 19 in combination with shaft members 16 and 17 provide an enhanced aesthetic appearance to the overall frame, a factor which is of importance in the marketing of the product.

As has been indicated, I have, by experimentation, discovered that certain critical dimensional factors provide optimum performance for a tennis racket according to my invention. These critical dimensional characteristics are set forth in FIGS. 2 and 3. Of particular importance are the dimensional characteristics which prevent the "chattering" felt by the player in the handle portion 13 when a ball strikes netting 14 in the region of point 20 on the netting, that point lying in proximity to the portion of the frame of greatest distance from handle portion 13. The longitudinal dimension of frame 10 approximates 27 inches as shown at designation 21 in FIG. 3.

Figure 2:
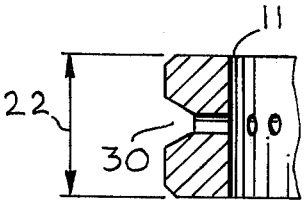
FIG. 2 is a sectional view taken along the line 2—2 in FIGS. 1 and 3.

The thickness of frame 10, as shown in FIG. 2, is critically set at 0.580 inches plus 0.020 inches, minus 0.000 inches and is designated dimension 22 in FIG. 2. Head 11 is consistent in this dimension throughout its extent, and that dimension may be carried on into shaft arms 16 and 17 although they may have a thickness dimension enlarged to 0.600 inches. Using the aluminum alloys which have been designated herein, the use of this critical dimension has eliminated the chattering to which earlier forged rackets described briefly in my U.S. Pat. No. 3,702,189 were subject. The width dimension for head 11 may vary from 0.280 ± 0.020 inches in the region of reference 31 to 0.230 ± 0.020 inches in the sides of head 11 and 0.200 ± 0.020 inches in the region of reference 32.

For best "playability" I have found that the balance of the racket should be such that, for a racket of 27 inches in overall length, the balance point should appear at about 13⅛ inches from the tip of handle portion 13. Such a racket is described as being "two to three points light in the head." A "point" in racket design is ⅛ inch, so that a racket with the balance point indicated for the subject racket would be described more accurately as being "three points light in the head". To achieve this balance point it is necessary to proportion the remaining elements of the frame 10. The dimension designated 23 in FIG. 3 may be 2.00 inches. Dimension 24 between struts 18 and 19 may have a dimension of 3½ inches and dimension 25 between strut 19 and handle portion 13 may also have a dimension of 3½ inches. The width dimensions 26 and 27 of shaft portions 16 and 17, respectively, may be 0.150 to 0.160 inches. In yoke portions 28 and 29 the width dimension may increase to 0.155 to 0.175 inches. It is in this region of the lower portion of head 11 and the yoke extensions of shafts 16 and 17, namely yoke portions 28 and 29, that the main torsional stresses are produced during use of the racket. Struts 18 and 19 have a width dimension of 0.100 to 0.120 inches.

As can be seen from FIG. 2 a groove 30 may be provided for recessing of the strings which make up netting 14. The depth of groove 30 may be 0.130 ± 0.020 inches.

As has been indicated, the dimensions recited here, particularly the dimension 22 which is the thickness of the head portion 11, are critical and, again, that thickness dimension must be kept within the tolerance limits indicated if the deleterious chattering effects are to be eliminated while retaining the other desired characteristics of the frame and the racket.

It should be noted that to achieve the critical dimensions which provide the unique performance of the tennis racket according to the present invention extensive milling of the forged racket is undertaken before the racket is completed. To emphasize that point, the racket direct from the forging operation weighs five pounds. When it is completed, but without strings, it weighs only about 13 ounces for a medium range racket.

Thus, although there have been described hereinbefore specific arrangements of an improved tennis racket in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of this invention.

What is claimed is:

1. A tennis racket comprising:

a one-piece forged metal frame having a longitudinal dimension of approximately 27 inches and a thickness dimension of 0.580 inches plus 0.020 inches, minus 0.000 inches, the frame having a standard oval head portion and a handle portion interconnected by a shaft portion, said head portion comprising opposed ends and opposed sides and having a first thickness dimension in the range of 0.580–0.600 inches and a first width dimension tapering from 0.280 ± 0.020 inches at the end remote from the shaft portion to 0.200 ± 0.020 inches at the end adjacent the shaft portion, the sides being 0.230 ± 0.020 inches in width;

said shaft portion including a first arm having second width and second thickness dimensions and a second arm having third width and third thickness dimensions;

said second and third width dimensions being equal; and said second and third thickness dimensions being equal, the material of the frame including aluminum.

2. A racket according to claim 1 in which said first and second arms are interconnected by first and second transverse struts spaced along the length of said arms.

3. A racket according to claim 2 in which said second strut is spaced substantially midway between said handle portion and said first strut.

4. A racket according to claim 3 wherein said first and second struts are located on opposite sides of the balance point of the frame.

5. A racket according to claim 2 wherein the struts have a width dimension in the range of 0.100–0.120 inches.

6. A racket according to claim 1 in which said second and third width dimensions lie in the range from 0.150 inches to 0.160 inches and said second and third thickness dimensions are approximately 0.600 inches.

7. A racket according to claim 1 in which the balance point along the length of the racket is displaced from the longitudinal dimensional centerpoint toward said handle portion.

8. A racket according to claim 7 in which said displacement of said balance point is approximately 0.375 inches.

9. A racket according to claim 1 in which the width of the head portion between each side and its adjacent ends tapers smoothly between the side width dimension and the corresponding end width dimensions.

10. A racket according to claim 9 wherein the thickness of the head is less than 0.600 inches and is uniform throughout, and wherein the thickness of the frame changes gradually from the thickness of the head to approximately 0.600 inches thickness in the shaft portion.

11. A racket according to claim 10 further including a pair of yoke portions respectively joining the shaft portions to the head portion, the yoke portions having a width dimension in the range of 0.155–0.175 inches and tapering smoothly to the width dimension of the adjacent shaft portions.

12. A tennis racket in accordance with claim 1 wherein the material of the frame is 2014-T6 aluminum alloy.

13. A tennis racket in accordance with claim 1 wherein the material of the frame comprises one of the 7000 series aluminums.

* * * * *